United States Patent [19]

Newman

[11] Pátent Number: 4,713,168

[45] Date of Patent: Dec. 15, 1987

[54] PREMIUM COKING PROCESS

[75] Inventor: Bruce A. Newman, Ponca City, Okla.

[73] Assignee: Conoco Inc., Ponca City, Okla.

[21] Appl. No.: 901,851

[22] Filed: Aug. 29, 1986

[51] Int. Cl.[4] ..... C10G 9/14

[52] U.S. Cl. ..... 208/131; 208/132; 208/50

[58] Field of Search ..... 208/131

[56] References Cited

U.S. PATENT DOCUMENTS

| | | | |
|---|---|---|---|
| 1,322,762 | 11/1919 | Cobb | 208/117 |
| 1,867,823 | 7/1932 | Halloran et al. | 208/117 |
| 1,881,901 | 10/1932 | Osmer | 208/117 |
| 1,909,587 | 5/1933 | Kuhl et al. | 196/76 |
| 3,619,413 | 11/1971 | Folkins | 208/131 |
| 4,178,229 | 12/1979 | McConaghy et al. | 208/131 |
| 4,235,703 | 11/1980 | Kegler et al. | 208/131 |
| 4,394,250 | 7/1983 | Grossberg | 208/108 |
| 4,479,804 | 10/1984 | Chen et al. | 208/131 |
| 4,490,244 | 12/1984 | Steeker | 208/131 |

*Primary Examiner*—Andrew H. Metz
*Assistant Examiner*—Helane Myers
*Attorney, Agent, or Firm*—Richard W. Collins

[57] ABSTRACT

In a delayed premium coking process the particle size of the premium coke is increased by the addition of a Lewis acid such as aluminum chloride to the coking process. Preferably the aluminum chloride is added during the latter part of the coking cycle.

2 Claims, 2 Drawing Figures

PREMIUM COKING PROCESS

BACKGROUND AND SUMMARY OF THE INVENTION

There is an increasing demand for high quality premium coke for the manufacture of large graphite electrodes for use in electric arc furnaces employed in the steel industry. A number of properties are of importance in characterizing the quality of graphite electrodes. One such property is density. Usually the higher the density the better the electrode. The quality of premium coke used in graphite electrodes is also measured by its coefficient of thermal expansion which may vary from as low as minus five to as high as plus eight centimeters per centimeter per degree centigrade $\times 10^{-7}$. Users of premium coke continuously seek graphite materials having higher densities and lower CTE values.

Premium coke is manufactured by delayed coking in which heavy hydrocarbon feedstocks are converted to coke and lighter hydrocarbon products. In the process the heavy hydrocarbon feedstock is heated rapidly to cracking temperature and is fed into a coke drum. The heated feed soaks in the drum in its contained heat which is sufficient to convert it into coke and cracked vapors. The cracked vapors are taken overhead and fractionated with the fractionator bottoms being recycled to the feed if desired. The coke accumulates in the drum until the drum is filled with coke, at which time the heated feed is diverted to another coke drum while the coke is removed from the filled drum. After removal the coke is calcined at elevated temperatures to remove volatile materials and to increase the carbon to hydrogen ratio of the coke.

In the manufacture of large graphite electrodes calcined premium coke particles obtained from the delayed coking process are mixed with pitch and then baked at elevated temperatures to carbonize the pitch. Since pitch loses its density faster than coke the higher the percentage of coke in the mixture the greater the density of the resulting electrode. The percentage of coke can be maximized by providing the proper gradation of size of coke particles. In the usual premium coking operation an excess of small particles is produced and the resulting electrodes do not reach maximum density. This it is desirable to provide a process which produces a higher proportion of larger coke particles.

According to this invention, premium coke having increased particle size is obtained by carrying out the delayed premium coking process in the presence of an added Lewis acid, such as aluminum chloride. In one aspect of the invention the aluminum chloride is added during the latter part of the delayed coking process.

PRIOR ART

U.S. Pat. No. 1,867,823 discloses the cracking of hydrocarbons such as gas oil with aluminum chloride at temperatures of about 500° to 700° F. for a time period of about 6 hours. The residuum from the process is coked in a retort at suitable temperatures, e.g. 1800° F. Gases from the retort (aluminum chloride, hydrogen chloride, and hydrocarbons) are removed and further processed. The conditions employed in the patent are entirely different from the delayed coking operation and further the patent does not mention premium coke.

U.S. Pat. No. 1,909,587 also discloses an aluminum chloride cracking process. In this patent fluidized particles of residual tar obtained from the cracking process are passed countercurrent to high temperature gases to provide instantaneous carbonization or coking. This operation is entirely unrelated to delayed coking and again there is no mention of premium coke.

U.S. Pat. Nos. 1,881,901 and 1,322,762 also deal with the treatment or cracking of petroleum oils with aluminum chloride. In each patent there is only an incidental mention of coking residuum from the process.

U.S. Pat. No. 4,394,250 relates to delayed coking, however this patent is concerned with the addition of a cracking catalyst to increase the amount of distillate produced in the coking process. The patent does not suggest the use of aluminum chloride and the purpose of the patent is to reduce coke yield rather than to increase coke yield.

DETAILED DESCRIPTION OF THE INVENTION

The fresh feedstocks used in carrying out the invention are heavy aromatic mineral oil fractions. These feedstocks can be obtained from several sources including petroleum, shale oil, tar sands, coal and the like. Specific feedstocks include decant oil, also known as slurry oil or clarified oil, which is obtained from fractionating effluent from the catalytic cracking of gas oil and/or residual oils. Another feedstock which may be employed is ethylene or pyrolysis tar. This is a heavy aromatic mineral oil which is derived from the high temperature thermal cracking of mineral oils to produce olefins such as ethylene. Another feedstock is vacuum resid which is a heavy residual oil obtained from flashing or distilling a residual oil under a vacuum. Still another feedstock is vacuum gas oil which is a lighter material obtained from flashing or distillation under vacuum. Thermal tar may also be used as a feedstock. This is a heavy oil which may is obtained from fractionation of material produced by thermal cracking of gas oil or similar materials. Heavy premium coker gas oil is still another feedstock and is the heavy oil obtained from liquid products produced in the coking of oils to premium coke. Gas oil from coking operations other than premium coking may also be employed as a feedstock. Virgin atmospheric gas oil may also be used as a feedstock. This is gas oil produced from the fractionation of crude oil under atmospheric pressure or above. Another feedstock which may be used is extracted coal tar pitch. Any of the preceding feedstocks may be used singly or in combination. In addition any of the feedstocks may be subjected to hydrotreating and/or thermal cracking prior to their use for the production of premium grade coke.

While aluminum chloride is the preferred material for use in carrying out the process, other Lewis acids, such as aluminum bromide, boron fluoride, zinc chloride and stannic chloride, may also be used in the practice of the invention.

Figure 1:
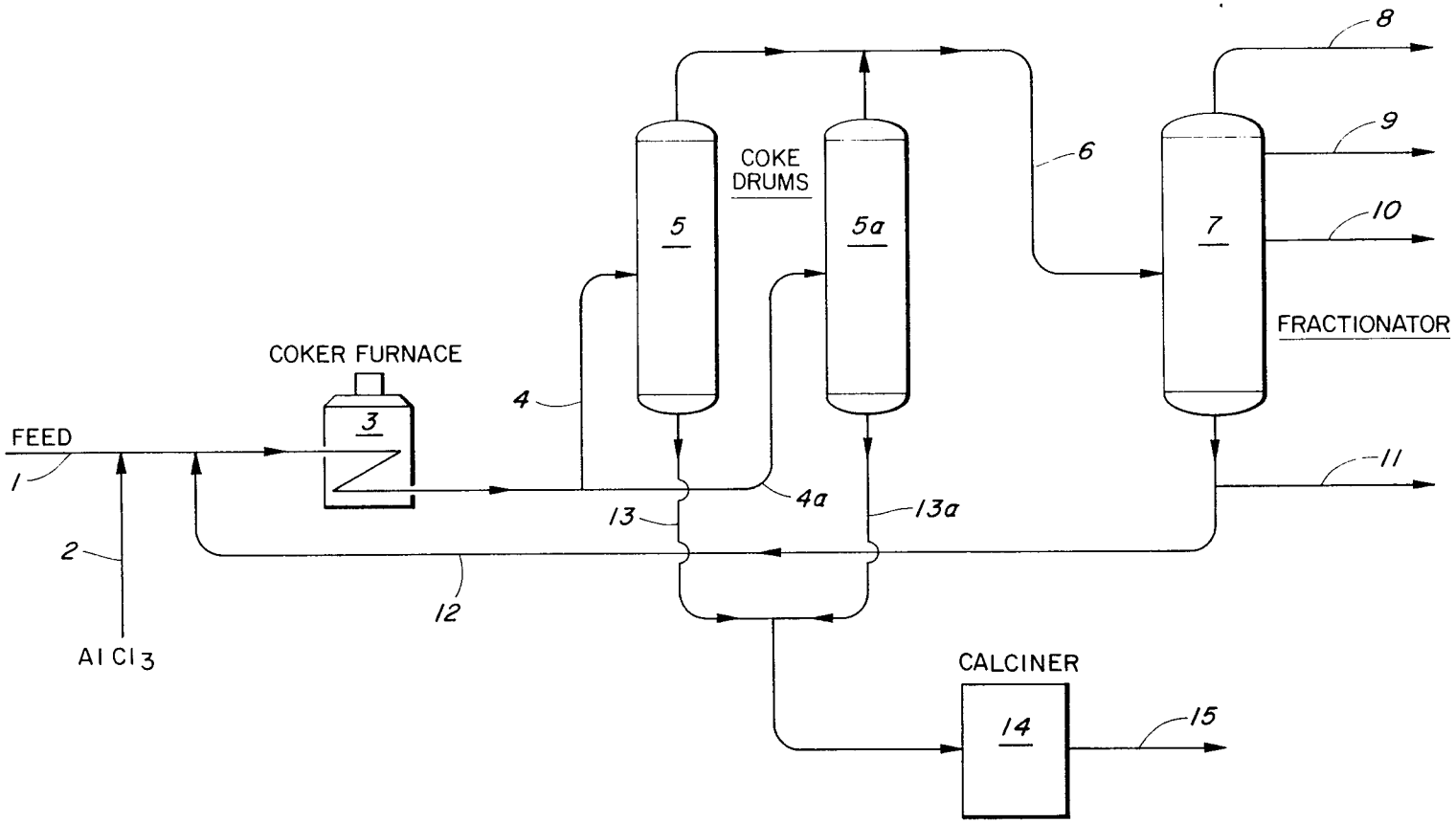
FIG. 1 is a schematic flow diagram which illustrates one embodiment of the invention.

Referring now to FIG. 1, feedstock is introduced into the coking process via line 1 together with aluminum chloride introduced through line 2. The aluminum chloride may be added as a powder, or if the feedstock is at a temperature above the melting point of aluminum chloride it may be introduced to the feedstock as a liquid. While FIG. 1 shows the aluminum chloride being combined with the feedstock before the feedstock enters the furnace it may if desired be separately introduced to coke drums 5 and 5A, either as a powder or a liquid, or it may be combined with the effluent from the furnace. The amount of aluminum chloride or other Lewis acid used in carrying out the invention will depend on the feedstock used and the coking conditions employed. Usually it will vary from about 0.01 to about 5.0 percent by weight based on the feedstock and preferably between about 0.045 and about 1.8 weight percent.

The feedstock which in this instance is a thermal tar is heated in furnace 3 to temperatures normally in the range of about 850° F. to about 1100° F. and preferably between about 900° F. to about 975° F. A furnace that heats the thermal tar rapidly to such temperatures, such as a pipestill, is normally used. The thermal tar exits the furnace at substantially the above indicated temperatures and is introduced through line 4 into the bottom of coke drum 5 which is maintained at a pressure of between about 15 and about 200 psig. The coke drum operates at a temperature in the range of about 800° F. to about 1000° F., more usually between about 820° F. and about 950° F. Inside the drum the heavy hydrocarbons in the thermal tar crack to form cracked vapors and premium coke.

The vapors are continuously removed overhead from the drum through line 6. The coke accumulates in the drum until it reaches a predetermined level at which time the feed to the drum is shut off and switched to a second coke drum 5A wherein the same operation is carried out. This switching permits drum 5A to be taken out of service, opened, and the accumulated coke removed therefrom using conventional techniques. The coking cycle may require between about 16 and about 60 hours but more usually is completed in about 24 to about 48 hours.

The vapors that are taken overhead from the coke drums are carried by line 6 to a fractionator 7. As indicated in the drawing, the vapors will typically be fractionated into a $C_1$–$C_3$ product stream 8, a gasoline product stream 9, a light gas oil product stream 10 and a premium coker heavy gas oil taken from the fractionator via line 11.

As indicated previously the premium coker heavy gas oil from the fractionator may be recycled at the desired ratio to the coker furnace through line 12. Any excess net bottoms may be subjected to conventional residual refining techniques if desired.

Green coke is removed from coke drums 5 and 5A through outlets 13 and 13A, respectively, and introduced to calciner 14 where it is subjected to elevated temperatures to remove volatile materials and to increase the carbon to hydrogen ratio of the coke. Calcination may be carried out at temperatures in the range of between about 2000° F. and about 3000° F. and preferably between about 2400° to about 2600° F. The coke is maintained under calcining conditions for between about one half hour and about ten hours and preferably between about one and about three hours. The calcining temperature and the time of calcining will vary depending on the density of the coke desired. Calcined premium coke which is suitable for the manufacture of large graphite electrodes is withdrawn from the calciner through line 15.

The following examples illustrate the results obtained in carrying out the invention.

EXAMPLES

To provide a base case a cracked refinery feedstock having the properties shown in Table 1 was coked at temperatures ranging from 825° to 890° F. at 60 psig and for a time period of 8 hours. Similar coking runs were carried out using the same feedstock with three levels of aluminum chloride added to the feed, namely 0.045 weight percent, 0.45 weight percent, and 1.8 weight percent aluminum chloride. The results of the runs are shown below in Table 2.

TABLE 1

| Feedstock Physical Properties | |
|---|---|
| Boiling Range, °F. | 720+ |
| Specific Gravity @ 60° F. | 1.055 |
| $C^{13}$ Analysis, % of Carbon in the Aromatic Form | 65.0 |
| Oxygen, Wt % | 1.2 |
| Sulfur, Wt % | 0.55 |
| Richfield Insolubles Content, Wt % | 1.7 |
| CHNPE, Wt % | |
| N | 0.3 |
| C | 90.6 |
| H | 8.3 |

TABLE 2

| Feedstock Description | | COKING TEMPERATURE, °F.* | | | |
|---|---|---|---|---|---|
| | | 825 | 840 | 855 | 890 |
| Cracked Refinery Feedstock (Base Case) | Calcining Yield, Wt %** | 22.3 | 33.9 | 63.6 | 86.2 |
| | Green Coke Yield, Wt % | 52.1 | 46.8 | 41.2 | 35.3 |
| | Overall Yield, Wt %*** | 11.6 | 15.9 | 26.2 | 30.4 |
| | Coke CTE, $10^{-7}$/°C. | 11.0 | 8.7 | 3.6 | 1.8 |
| | Coke Size (Green Coke) Wt % +30 Mesh | 26.1 | 28.7 | 37.6 | 75.3 |
| | Green Coke Sulfur, Wt % | — | — | 0.62 | 0.52 |
| | Green Coke Aluminum, ppm | 2.8 | 2.7 | <8 | <8 |
| | Green Coke Fe, ppm | — | — | 108 | 70 |
| | Green Coke Chlorine, Wt % | <0.01 | <0.01 | — | — |
| Cracked Refinery Feedstock Plus 0.045 Wt % $AlCl_3$ | Calcining Yield, Wt %** | 23.0 | 39.1 | 74.8 | 84.2 |
| | Green Coke Yield, Wt % | 51.9 | 46.8 | 42.0 | 35.7 |
| | Overall Yield, Wt %*** | 11.9 | 18.3 | 31.4 | 30.1 |
| | Coke CTE, $10^{-7}$/°C. | 12.2 | 8.4 | 4.7 | 2.1 |
| | Coke Size (Green Coke) Wt % +30 Mesh | 30.1 | 34.4 | 36.7 | 74.3 |
| | Green Coke Sulfur, Wt % | — | — | 0.64 | 0.54 |
| | Green Coke Aluminum, ppm | 51 | 74 | 67 | 70 |
| | Green Coke Fe, ppm | — | — | 292 | 665 |

TABLE 2-continued

| Feedstock Description | | COKING TEMPERATURE, °F.* 825 | 840 | 855 | 890 |
|---|---|---|---|---|---|
| | Green Coke Chlorine, Wt % | <0.01 | <0.01 | — | — |
| Cracked Refinery Feedstock | Calcining Yield, Wt %** | 46.0 | 61.7 | 71.8 | 84.1 |
| Plus | Green Coke Yield, Wt % | 51.5 | 47.0 | 41.7 | 37.5 |
| 0.45 Wt % $AlCl_3$ | Overall Yield, Wt %*** | 23.7 | 29.0 | 29.9 | 31.5 |
| | Coke CTE, $10^{-7}$/°C. | 18.6 | 10.1 | 4.0 | 3.6 |
| | Coke Size (Green Coke) Wt % +30 Mesh | 34.2 | 45.0 | 51.5 | 75.4 |
| | Green Coke Sulfur, Wt % | — | — | 0.66 | 0.62 |
| | Green Coke Aluminum, ppm | 640 | 630 | 700 | 960 |
| | Green Coke Fe, ppm | — | — | 1430 | 2530 |
| | Green Coke Chlorine, Wt % | 0.09 | 0.04 | — | 0.065 |
| Cracked Refinery Feedstock | Calcining Yield, Wt %** | 66.6 | 76.9 | 79.4 | 84.4 |
| Plus | Green Coke Yield, Wt % | 48.4 | 45.5 | 41.3 | 37.8 |
| 1.8 Wt % $AlCl_3$ | Overall Yield, Wt %*** | 32.3 | 35.0 | 32.8 | 31.9 |
| | Coke CTE, $10^{-7}$/°C. | 11.0 | 6.9 | 3.3 | 4.2 |
| | Coke Size (Green Coke) Wt % +30 Mesh | 37.2 | 45.4 | 61.0 | 77.1 |
| | Green Coke Sulfur, Wt % | — | — | 0.56 | 0.55 |
| | Green Coke Aluminum, ppm | 4200 | 4200 | 4500 | 4300 |
| | Green Coke Fe, ppm | — | — | 1960 | 2610 |
| | Green Coke Chlorine, Wt % | 0.22 | 0.32 | 0.27 | — |

*Coking pressure = 60 PSIG and time = 8 hours in all cases.
**Calcining yield = (calcined coke yield/green coke) × 100.
***Overall yield = calcining yield × green coke yield/100.

The data in Table 2 show that adding aluminum chloride to the coking process has a substantial effect in increasing the coke size of the green coke. In addition, the use of aluminum chloride can produce a large increase in the yield of calcined coke. These results are obtained without a substantial increase of CTE of the calcined coke.

Figure 2:
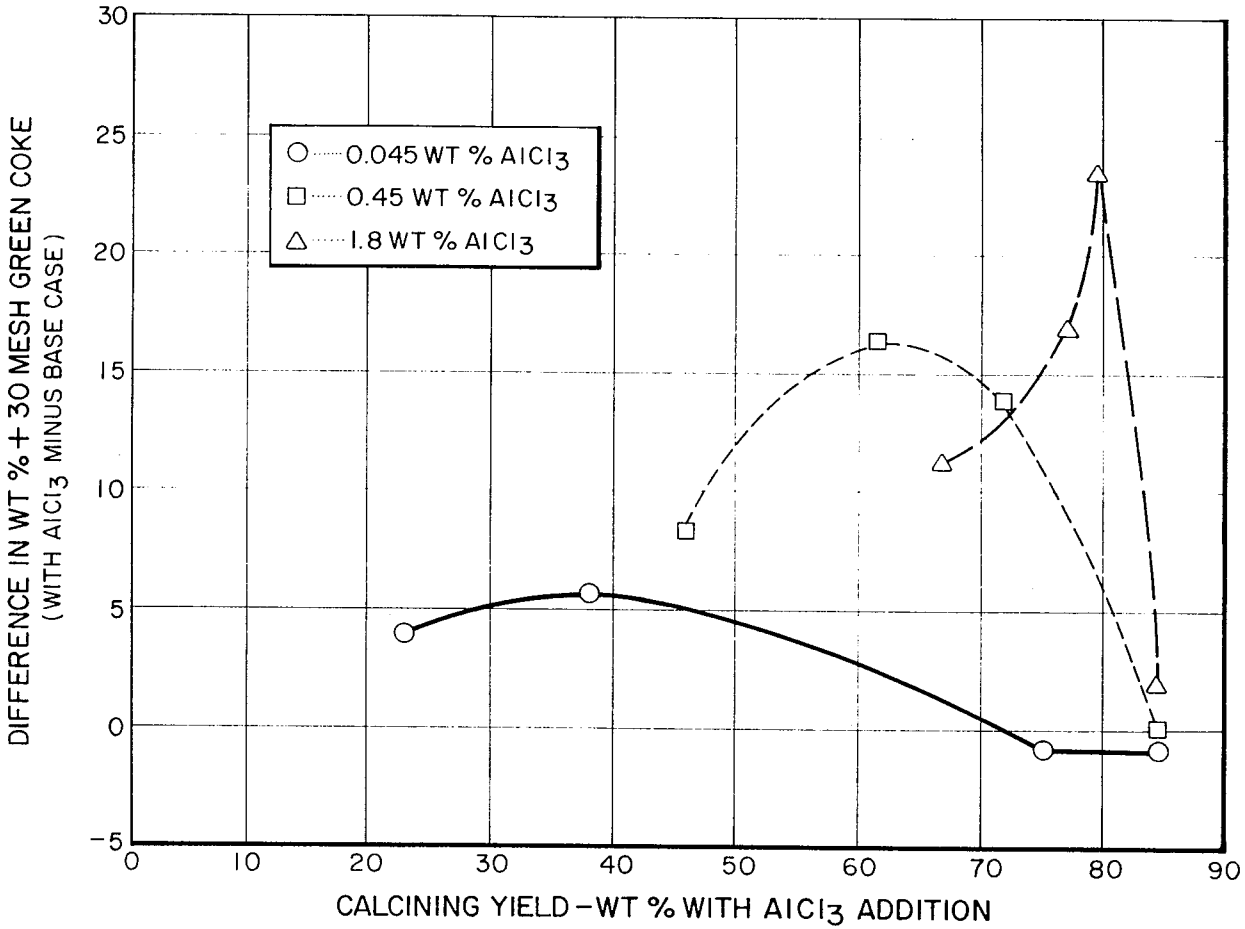
FIG. 2 is a chart in which there is plotted for three different levels of aluminum chloride addition the relationship between calcining yield and the difference in weight percent of +30 mesh green coke produced with and without the addition of aluminum chloride.

FIG. 2 of the drawings was prepared from the data set forth in Table 2. The ordinate values were obtained by subtracting the weight percent +30 mesh green coke in the base case from corresponding values for the runs with aluminum chloride at the same reaction temperature. The values for the abscissa were obtained by using the calcining yield weight percent for the corresponding aluminum chloride runs used in calculating the values for the abscissa. For example, if we take the first run in Table 2, the coke size for the base case at 825° is 26.1 weight percent of +30 mesh coke. The corresponding value in the run at the same temperature with 0.045 weight percent aluminum chloride is 30.1. The difference between these values is 4.0 which is the value of the ordinate for the fartherest left point on the curves in FIG. 2. The calcining yield for the 0.045 weight percent aluminum chloride run at 825° F. is 23.0. These two values 4.0 and 23.0 serve to locate the fartherest left point on the curves in FIG. 2 (which is shown by a circle). Each of the other points for the runs in which 0.045 weight percent aluminum chloride was added were obtained in a similar manner as were the points for the 0.45 and 1.8 weight percent aluminum chloride addition.

In viewing the curves of FIG. 2 it is apparent that the addition of aluminum chloride has a substantial effect on the production of increased amounts of +30 mesh green coke. However it is also noted that as the percent calcining yield increases, a point is reached at which added aluminum chloride has little or no effect. As is apparent from FIG. 2, this point may vary from as low as about 70 percent calcining yield to as high as about 85 percent calcining yield, depending on the amount of $AlCl_3$ being added to the coking reaction. If we can determine how many hours it takes for the coke to reach between about 70 and about 85 weight percent and preferably between about 75 and about 85 weight percent calcining yield, then we can establish the point in the delayed coking cycle where it would be most desirable to start adding aluminum chloride. For example, if it takes 10 hours to reach a calcining yield of about 75 to 85 weight percent and the coking cycle lasts for 32 hours then we would want to start introducing aluminum chloride at a point about 22 hours into the coking cycle.

Table 3 contains data on another cracked refinery feedstock which was coked at 850° and at 875° F. In each run the coking reaction was carried out for 48 hours with the yield of calcined coke being determined at intervals during the coking process.

TABLE 3

Calcining Yield vs. Reaction Time

| Reaction Time, Hr | CALCINING YIELD, WT % 850° F. Coking Temperature | 875° F. Coking Temperature |
|---|---|---|
| 2 | — | 20.9 |
| 4 | 16.2 | 43.6 |
| 8 | 59.0 | 84.3 |
| 16 | 83.4 | 91.5 |
| 24 | — | 88.4 |
| 32 | 90.3 | — |
| 48 | 90.7 | 90.8 |

Referring to the data in Table 3, note that the calcining yield in the run at 850° F. reached 75 to 85 percent shortly after 16 hours of reaction time. By interpolation the time was determined to be approximately 18 hours. At this reaction temperature the optimum time to start adding aluminum chloride to the reaction would be approximately 18 hours from the end of the reaction time. In the run at 875° F., 75 to 85 percent calcining yield was reached at about 9 hours of reaction time. Therefore at this coking temperature the preferred time for adding aluminum chloride would be during the last 9 hours of the reaction time.

I claim the following:

1. In a delayed premium coking process in which an aromatic mineral oil feedstock is heated to an elevated temperature and introduced into a coking drum under delayed coking conditions, the improvement comprising:

(a) determining the time required at said coking conditions to obtain a calcining yield of from 70 to 85 weight percent; and (b) adding a Lewis acid to said coking drum during only the latter portion of the introduction of feedstock to said coking drum, said latter portion being a period equal to the time determined in step (a), whereby the proportion of +30 mesh coke product resulting is increased without a substantial increase in the CTE of said coke.

2. The process of claim 1 wherein said Lewis acid is aluminum chloride.

* * * * *